US005388360A

United States Patent [19]

Fortunato

[11] Patent Number: 5,388,360

[45] Date of Patent: Feb. 14, 1995

[54] LOADER WITH TILTING CARTRIDGES FOR PISTOL OR MACHINE PISTOL

[75] Inventor: Canio Fortunato, Cheratte, Belgium

[73] Assignee: Fabrique Nationale Nouvelle Herstal, en abrege FNNH, societe anonyme, Herstal, Belgium

[21] Appl. No.: 974,586

[22] PCT Filed: Jun. 19, 1992

[86] PCT No.: PCT/BE92/00026

§ 371 Date: Feb. 22, 1993

§ 102(e) Date: Feb. 22, 1993

[30] Foreign Application Priority Data

Jun. 20, 1991 [BE] Belgium ..... 09100595

[51] Int. Cl.[6] ..... F41A 9/69

[52] U.S. Cl. ..... 42/50; 42/7

[58] Field of Search ..... 42/7, 6, 50, 18, 22; 89/195, 196, 197, 34

[56] References Cited

U.S. PATENT DOCUMENTS

| | | | |
|---|---|---|---|
| Re. 11,800 | 1/1900 | Wesson . | |
| 875,209 | 12/1907 | Prinke | 89/197 |
| 886,211 | 4/1908 | Hino et al. | 42/7 |
| 944,930 | 12/1909 | Whiting | 42/7 |
| 1,365,743 | 1/1921 | Stokke | 42/18 |
| 1,533,966 | 4/1925 | Browning | 42/18 |
| 2,427,304 | 9/1947 | Robbins | 42/3 |
| 2,895,248 | 7/1959 | Sawin | 42/50 |
| 4,539,889 | 9/1985 | Glock | 89/147 |
| 4,825,744 | 5/1989 | Glock | 89/145 |
| 4,893,546 | 1/1990 | Glock | 89/145 |
| 5,012,743 | 5/1991 | Denis et al. | 102/514 |
| 5,113,604 | 5/1992 | Vyprachticky | 42/50 |

FOREIGN PATENT DOCUMENTS

| | | | |
|---|---|---|---|
| 512618 | 2/1954 | Belgium | 89/197 |
| 451155 | 9/1948 | Canada | 42/18 |
| 581433 | 8/1959 | Canada | 42/50 |
| 756302 | 12/1933 | France | 89/196 |
| 789580 | 10/1935 | France | 89/197 |
| 61292 | 10/1892 | Germany | 42/18 |
| 3297 | 3/1891 | Switzerland | 42/18 |
| 3432 | 4/1891 | Switzerland | 42/18 |
| 372653 | 5/1932 | United Kingdom | 42/50 |

*Primary Examiner*—Stephen M. Johnson
*Attorney, Agent, or Firm*—Foley & Lardner

[57] ABSTRACT

The loader contains a flat case provided at its top end with two detention lips keeping back the cartridges in the latter whereas they can still be taken up by the recoil slide of the arm by pushing them forward in a transversal direction of the case, outside the case, a mobile feeder in the case, and a spring provided between this feeder and the lower end of the case. The top side of the feeder contains a front part extending more or less in the above-mentioned transversal direction and a back part which is inclined with regard to the front part toward the lower end in the direction of the back partition, whereby this partition contains a fixed exterior part and a mobile interior part, whereby the above-mentioned spring rests upon this interior part, the top end of the latter being provided with at least one protrusion situated at the height of the upper detention lips when the interior part is in the inserted position.

10 Claims, 2 Drawing Sheets

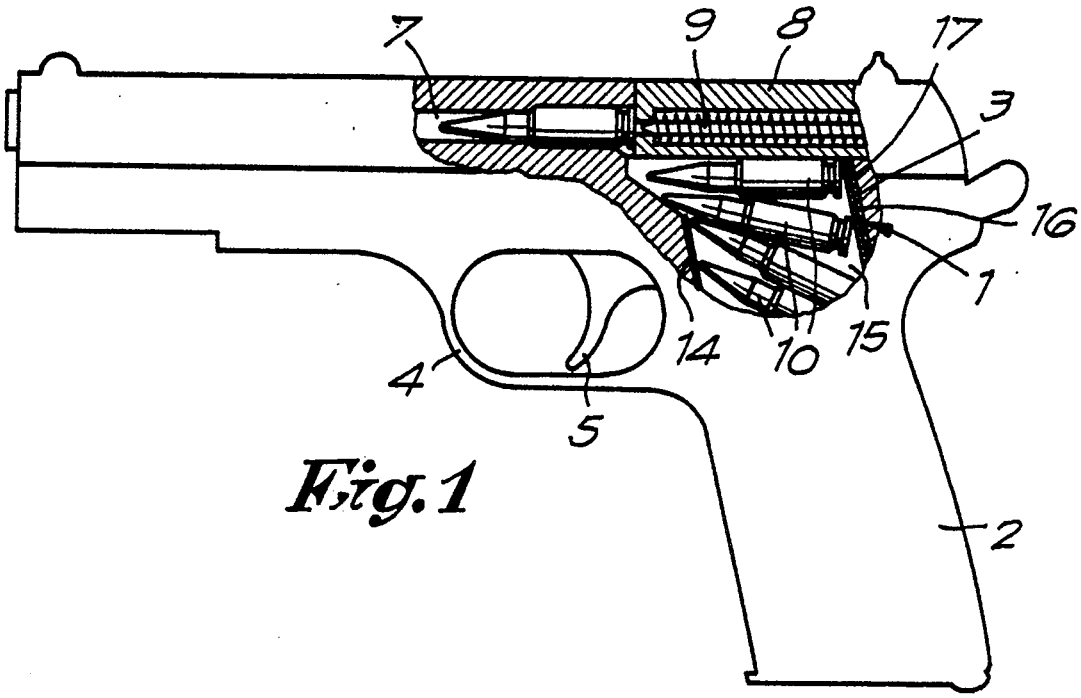
Fig. 1
Fig. 2
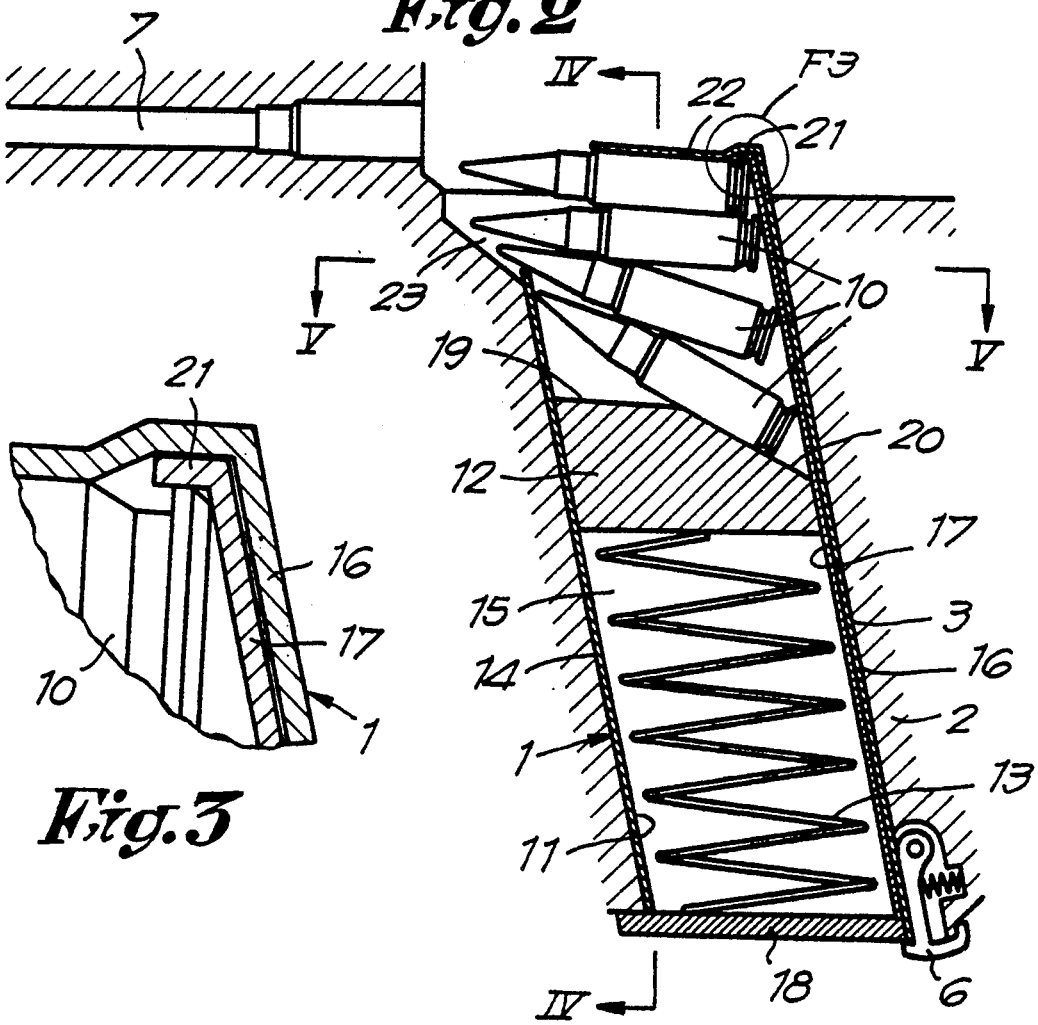
Fig. 3

LOADER WITH TILTING CARTRIDGES FOR PISTOL OR MACHINE PISTOL

BACKGROUND OF THE INVENTION

1. Field of the Invention

The invention concerns a loader for pistols or machine pistols whose grip is provided with a housing for such a loader. This loader can contain cartridges. It includes a flat case with a narrow partition, called the front partition, and a narrow so-called back partition and two thick side partitions. This case has two upper detention lips at one so-called top end, retaining, in the longitudinal direction of the case, the cartridges in the latter whereby a top cartridge can be taken up by the recoil slide of the arm, pushing said cartridge forward in the so-called transversal direction of the case, outside the case through an outlet opening. A mobile feeder in the case and a spring provided between this feeder and the lower end of the case functions to push the feeder upward.

2. Discussion of the Related Art

In the known loaders of this type, the top side of the feeder extends over its entire length in the abovementioned transversal direction of the case.

This transversal direction normally represents a feeble inclination with regard to the direction of the movement of the recoil slide of the arm, i.e. with regard to the axis of the barrel. Since, in most pistols, the grip and thus the housing for the loader are inclined with regard to the perpendicular line of this direction of the movement, the above-mentioned transversal direction is in most cases not perpendicular to the longitudinal direction of the loader, but is inclined with regard to this perpendicular.

These known loaders can only be used with cartridges whose length corresponds to the length of the top side of the feeder. Recently, however, cartridges have been introduced on the market whose length is superior to the current standards used for pistols or machine pistols as described in Belgian patent No. 1001874. Indeed, these long cartridges cannot be used in the known loaders designed for cartridges having a conventional length and in which all these cartridges extend in the transversal direction. Naturally, these long cartridges could be introduced in a longer loader, but this would require a bigger housing and thus a larger grip, which would make the pistol difficult to hold.

SUMMARY OF THE INVENTION

The invention aims to provide a loader which can contain long cartridges and which can be used with a pistol grip which remains ergonomically acceptable.

To this end, the top side of the feeder contains a front part extending more or less in the above-mentioned transversal direction of the case and a back part which is inclined with regard to the front part towards the lower end in the direction of the back partition. This back partition of the case contains a fixed exterior part with regard to the side partitions and a mobile interior part in the longitudinal direction of the case. The above-mentioned spring rests upon this interior part of the back partition, at the lower end, the top end of the mobile part being provided with at least one protrusion. This protrusion is situated at the height of the upper detention lips of the case when the interior mobile part is in the inserted position, but is shifted towards the lower end when this interior mobile part is in the outgoing position and passes beyond the fixed part of the back partition.

Thus, the above-mentioned "transversal direction" of the case is the direction in which the top cartridge has left the case via the recoil slide.

The cartridges can be introduced parallel to the front part of the top side of the feeder, whereby the mobile part of the back partition is in the inserted position. The cartridges slant strongly towards the back part of the top side of the feeder as the latter gradually descends towards the bottom partition.

The last introduced cartridge is kept in a parallel position with regard to the back part of the top side of the feeder, on the one hand by means of the front end of the detention lips and on the other hand in the back by means of the protrusion shifted towards the lower end. Thus, these cartridges can be longer than the length of the loader measured parallel with the front part of the top side of the feeder. After the filled loader has been introduced in the housing of the arm, the mobile part is moved by pushing its lower end in the inserted position. By doing so, the protrusion comes at the height of the detention lips and at least the top cartridge situated in front of the outlet opening tilts into a position in which it extends in the transversal direction of the case and can be taken up by the recoil slide.

According to an advantageous embodiment of the invention, the case contains a bottom partition which works in conjunction with the interior mobile part of the back partition, whereby the spring rests upon this mobile part through the medium of the bottom partition.

BRIEF DESCRIPTION OF THE DRAWINGS

In order to better explain the characteristics according to the invention, by way of example only and without being limitative in any way, the following example of an embodiment is described with reference to the accompanying drawings, in which:

FIG. 1 is a general side view with a partial section of a pistol provided with a loader according to the invention in locked position;

FIG. 2 shows a longitudinal section to a larger scale of the loader of the pistol in FIG. 1 of a part of the pistol;

FIG. 3 shows the part indicated by F3 in FIG. 2 to a larger scale;

DETAILED DESCRIPTION OF THE PREFERRED EMBODIMENTS

Figure 4:
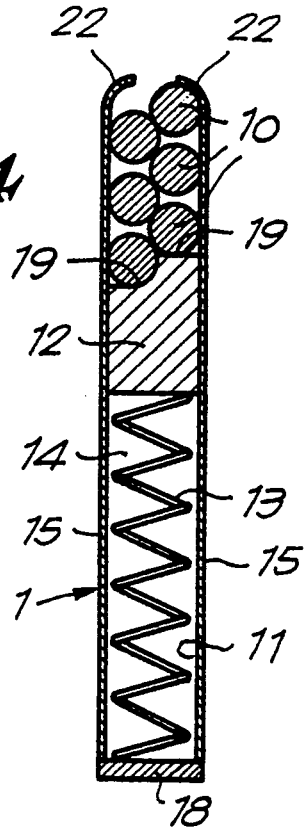
FIG. 4 represents a section according to line IV—IV in FIG. 2.
Figure 5:
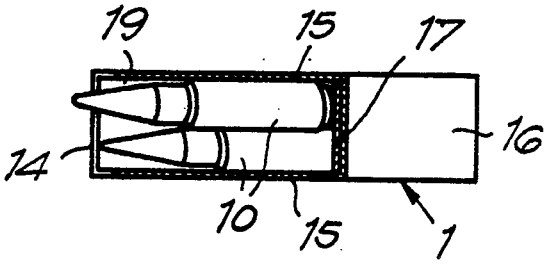
FIG. 5 represents a section according to line V—V in FIG. 2.

FIG. 1 shows a pistol provided with a loader 1 according to the invention. With the exception of the loader, the pistol is of a known construction and thus will only be briefly described.

The pistol has a casing 2 whose grip contains a housing for the loader 1. The casing 2 is provided with a trigger guard 4 in which appears a trigger 5. A locking element 6 allows for the immobilization of the loader 1 in the housing 3.

The casing 2 contains in the front the barrel 7 and supports in the back a recoil slide 8 guiding the hammer 9. This hammer can be controlled by the trigger 5 by means of a kinematic chain (not shown in FIG. 1).

These arrangements and their working are known and thus are not part of the invention.

The loader 1 in conformity with the invention and as represented in FIGS. 2 to 6 provides room for two rows of cartridges 10. It contains mainly a flat case 11, a mobile feeder 12 in the case and a spring 13 pushing the feeder 12 upward.

The case 11 contains a narrow front partition 14, two thick side partitions 15, a narrow back partition consisting of an exterior part 16 working in conjunction with the side partitions 14 and an interior part 17 moving along the exterior part 16, and a bottom partition 18 working in conjunction with the interior part 17.

The partitions 14, 15 and 16, 17 extend in the longitudinal direction of the case. The bottom partition 18 extends in the transversal direction. The transversal direction is the direction according to which the top cartridge extends before being pushed out of the case by the recoil slide 8 and the direction in which it leaves the case via said recoil slide. This direction is inclined a few degrees with regard to the moving direction of the recoil slide. Since the grip, the housing 3 and thus also the loader 1 introduced in this housing have a lower end which is slightly shifted to the back, the transversal direction of the case is considerably inclined towards the back at the front bottom with regard to the perpendicular in the longitudinal direction.

The above-mentioned spring 13 rests on the bottom partition 18 and pushes the feeder 12 in the direction of the top end of the case 11.

The top side of the feeder 12 has, in the direction of the depth of the case, two levels, one level for each row of cartridges 10. These levels are parallel to one another in the transversal direction.

The top side and thus the two levels of this side have two parts with a different inclination, namely a front part 19 extending in the transversal direction and a back part 20 inclined towards the lower end starting from the front part. The inclination of the back part 20 must be sufficient so that the cartridges 10 which are longer than the width of the case 11, measured parallel to said front part 19, can be housed in the case 11 as soon as they have the same inclination as the back part 20.

The top end of the mobile part 17 of the back partition has on the inside in the direction of the depth of the case 11 two protrusions 21 in the shape of tongues, one for each row of cartridges. These protrusions 21 can alternately hold back the end of the top cartridge 10, as will be explained afterwards below.

The cartridges 10 are driven back towards the top end of the loader, but they are held back there in the longitudinal direction by means of two detention lips 22, formed by two converging ends of the side partitions 15. The utmost extremities of these lips 22 extend in the transversal direction starting from the back partition 16, 17 onto an outlet opening 23 in front. The outlet opening 23 partly extends in the top end and partly in the front partition 14.

One single cartridge 10 at the time, alternately one of each row, presents itself at the top end, in front of the opening 23.

Figure 6:
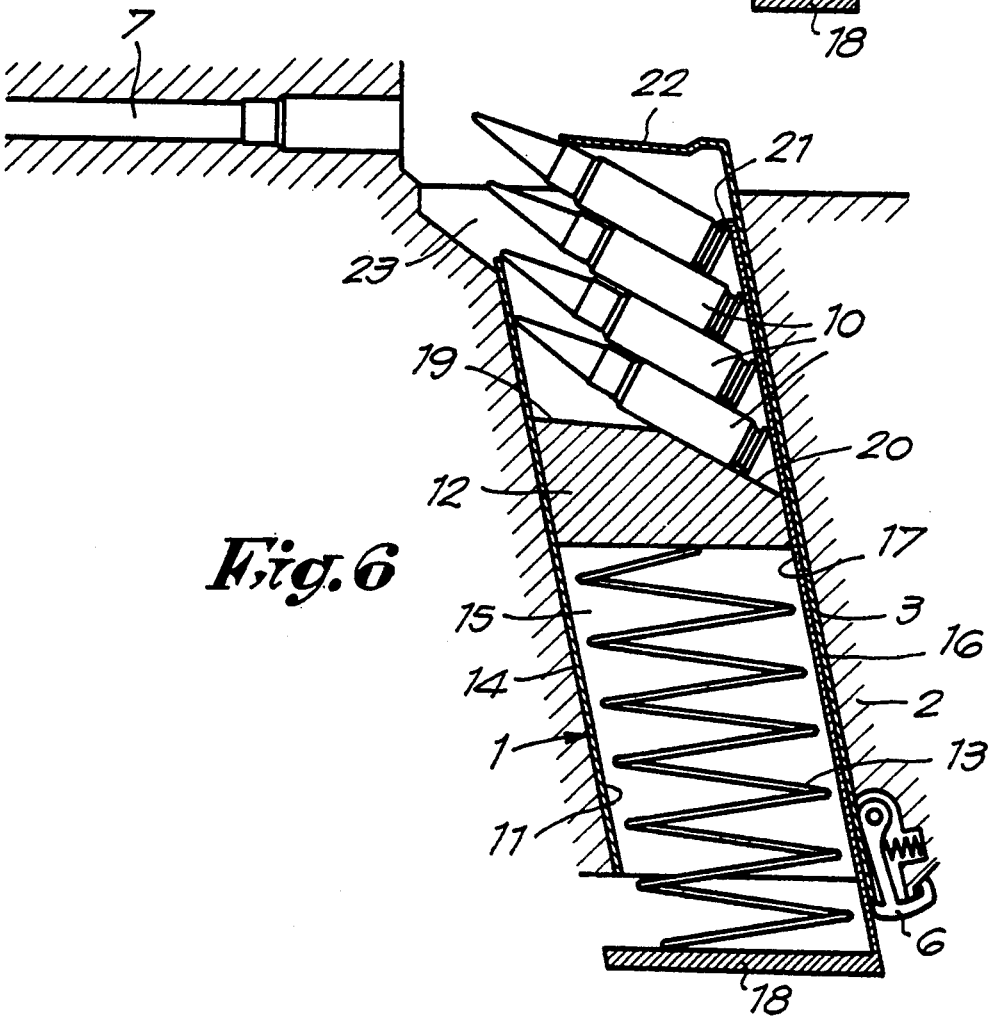
FIG. 6 shows a longitudinal section to a larger scale of the loader of the pistol in FIG. 1 and a part of the pistol, but in the non-locked position.

In FIG. 6, the loader 1 is represented in non-locked position and partially filled with cartridges 10. The mobile part 17 of the back partition 16,17 then forms a protrusion with regard to the fixed part 16, and the bottom partition 18 is pushed back by the spring 13 to a certain distance from the partitions 14 and 15. The cartridges which are housed there are alternately part of either of the two rows. Because of the inclined back part 20 of the top side of the feeder 12, the cartridges 10 automatically take up an inclined position and extend with their axes parallel to the above-mentioned back part 20. The top cartridge is retained at the back by one of the two protrusions 21 and, more in front by the front end of the detention lips 22. Due to the effect of the spring 13, this protrusion 21 draws the top cartridge 10 back directly or by means of other cartridges 10 against the inclined part 20 of the top side of the feeder 12.

The loader filled with cartridges is introduced in this position in the housing 3 of the arm. The locking element 6 is then in non-locked position. Once it has been introduced, the mobile part 17 of the back partition is put in inserted position by pushing the bottom partition 18 in the direction of the top end until it strikes against the lower end of the partitions 14 and 15 and of the grip of the casing 2. The loader 1 is shown in this position in FIGS. 1 to 5.

After this insertion, the locking element 6 is put in locked position. In this position the element not only immobilizes the loader 1 in the housing 3, but also at the same time locks the mobile part 17 with regard to the fixed part 16 of the back partition 16,17. Thus, the inserted position is also the locked position when the loader 1 is put into place.

In this locked position of the mobile part 17, the protrusions 21 are countersunk in the detention lips 22 of the case and these lips alone hold back the top cartridge 10. A cartridge 10 situated under the outlet opening 23 is parallel to the back part 20 of the top side of the feeder 12. Once it has reached the height of this opening, it can enter there and, since it is no longer held back by a protrusion 21, it will start tilting. As shown in FIG. 2, the top cartridge takes a position parallel to the above-mentioned transversal direction of the case, which implies that it assumes the normal position so as to be taken up by therecoil slide 8. If there is only one cartridge 10 in the loader 1, this rests, in the above-mentioned inserted position of the loader, on the front part 19 of the top side of the feeder 12.

According to the loading instructions, during the loading of the loader 1, the mobile part 17 of the back partition 16, 17 should be stabilized if not locked. Otherwise, this part 17 will come out of the fixed part 16 at each introduction of a new cartridge and the spring 13 will not compress. Moreover, the presence of the protrusion 21 would obstruct in the non-inserted position of the mobile part 17 the good introduction of the cartridges. For these reasons, the loader should be in inserted position while being loaded.

In order to remove the loader 1 from the housing 3, it should be put in non-locked position.

The loader 1 described above makes it possible to use long cartridges in an ergonomically acceptable grip.

Naturally, the above-described example can be made in various forms and dimensions while still remaining within the scope of the invention.

For example, the loader must not necessarily contain two rows of cartridges. It may have such dimensions that it can only contain one row, in which case the top side of the feeder naturally will not have two levels and the mobile part of the back partition will only have one protrusion.

I claim:

1. A cartridge loader for pistols or machine pistols having a grip provided with a housing for the loader, comprising:

(A) a casing extending in a longitudinal direction having:

(1) a plurality of longitudinal walls, including a front wall, a back wall substantially parallel to the front wall and two side walls between the front and back walls;

(2) at least one lip attached on one end of the casing to one of the side walls, for retaining cartridges inside the casing, the lip forming an upper end of the casing and extending in a transversal direction in which cartridges may be discharged from the casing by a recoil slide in the pistol or machine pistol;

(3) a bottom portion;

(B) a mobile feeder mounted inside the casing, having a top side including a front portion and a back portion, the back portion being inclined with respect to the transversal direction downwardly away from the front portion; and (C) a spring mounted in the casing between the feeder and the bottom portion;

(D) wherein the front wall and the lip define an opening for discharging cartridges;

(E) the back wall of the casing including an exterior portion fixed to the side walls and an interior portion shiftable in the longitudinal direction along the exterior portion, the bottom portion of the casing being fixed to one end of the interior portion; and (F) the interior portion having an upper end provided with at least one protrusion directed to the inside of the casing, for retaining cartridges, and being shiftable between an inserted position wherein the protrusion is situated at the upper end of the casing and a second position wherein the protrusion is situated below the upper end of the casing and wherein one end of the interior portion whereon the bottom portion of the casing is fixed projects outside the exterior portion.

2. Loader according to claim 1, wherein the top side (19,20) of the feeder (12) includes, in a direction of a depth of the case (11), two parallel levels for two rows of cartridges (10).

3. Loader according to claim 4, wherein the interior portion is provided with two protrusions (21), one for each of said rows of cartridges (10).

4. Loader according to claim 1, wherein the front portion and the back portion of the feeder include an upper face with two levels; and the interior portion of the back wall of the casing includes two protrusions.

5. Loader according to claim 1, wherein two lips are provided.

6. Loader according to claim 1, wherein the front and back walls are narrower than the side walls.

7. Loader according to claim 8, wherein the lip is formed by a converging end of the side partition (15) of the case (11) and the protrusion (21) is countersunk in the lip in the inserted position.

8. Loader according to claim 7, wherein two protrusions and two lips are provided, and wherein in the inserted position, the two protrusions are countersunk in the two lips (22).

9. Loader according to claim 1, further comprising a locking element immobilizing the loader (1) in the housing (3), whereby the locking means (6) immobilizes the loader (1) and the interior portion in the inserted position.

10. A cartridge loader for pistols or machine pistols having a grip provided with a housing for the loader, comprising:

(A) a casing extending in a longitudinal direction having:

(1) a plurality of longitudinal walls;

(2) at least one lip on one end of one of the walls, forming an upper end of the casing and extending in a transversal direction in which cartridges may be discharged from the casing, wherein at least one of the walls and the lip define an opening;

(3) a bottom portion;

(B) a mobile feeder mounted inside the casing and biased toward the upper end, having a front portion and a back portion inclined with respect to the transversal direction downwardly away from the front portion; and (C) at least one of the walls includes:

(1) a fixed portion fixed to at least one other wall;

(2) a slidable portion with at least one protrusion formed thereon directed to the inside of the casing, the slidable portion being slidable in the longitudinal direction, fixed to the bottom portion, shiftable between an inserted position wherein the protrusion is situated at the upper end and a second position wherein the protrusion is situated below the upper end.

* * * * *